US005415411A

United States Patent [19]

Peterson

[11] Patent Number: 5,415,411

[45] Date of Patent: May 16, 1995

[54] BOARD GAMES OF GLOBAL CONQUEST

[76] Inventor: LaVerne R. Peterson, 23 Lawley St., North Beach 6020 Western Australia, Australia

[21] Appl. No.: 319,067

[22] Filed: Oct. 6, 1994

[51] Int. Cl.[6] ..... A63F 3/04

[52] U.S. Cl. ..... 273/237; 273/262; 273/280; 273/430

[58] Field of Search ..... 273/256, 262, 280, 242, 273/237, 251–255, 267, 430

[56] References Cited

U.S. PATENT DOCUMENTS

| | | | |
|---|---|---|---|
| 2,273,292 | 2/1942 | Smith | 273/255 |
| 2,347,094 | 4/1944 | Fernandez | 273/236 |
| 3,064,979 | 11/1962 | Ralston | 273/267 |
| 3,508,753 | 4/1970 | Mackey | 273/237 |
| 3,948,524 | 4/1976 | Ladd | 273/243 |
| 4,029,321 | 6/1977 | Lang | 273/280 |
| 4,283,059 | 9/1981 | Beeder | 273/256 |
| 4,624,464 | 11/1986 | Propsom | 273/280 |
| 4,736,954 | 4/1988 | Haney | 273/236 |
| 5,085,439 | 2/1992 | Lott | 273/236 |
| 5,292,133 | 3/1994 | Alexander | 273/256 |

*Primary Examiner*—Benjamin H. Layno
*Attorney, Agent, or Firm*—Richard Litman

[57] ABSTRACT

Board games of global conquest include lighted and unlighted circular game boards having geopolitical maps of the globe thereon. Playing pieces of different types are provided for each player, with each type of playing piece having a different move pattern and limitations of moves on the board. At least one type of piece is never placed upon the board, but its position is known only to the player holding that piece. The object of the game is to form patterns of squares about various areas or nations of the board with the playing pieces, with a player successfully forming such a square being considered the conqueror of that nation or region. The conquering player must be able to identify the nation or region, and may receive simulated currency for correctly identifying the capitol and correctly answering other questions about the area. A conquering player may also rotate a rotatable playing surface overlying the maps of the boards, thereby displacing various playing pieces to incompatible areas and causing their loss. Playing pieces may be removed and replaced on the board more than once in the course of a game. Movable peripheral markers are used to identify nations or regions conquered. The winner is the player who collects the greatest amount of simulated currency during the course of play, which may be limited by time or by the conquering of a predetermined number of nations of the board, as well as by conquering all of the available nations.

20 Claims, 14 Drawing Sheets

FIG. 4
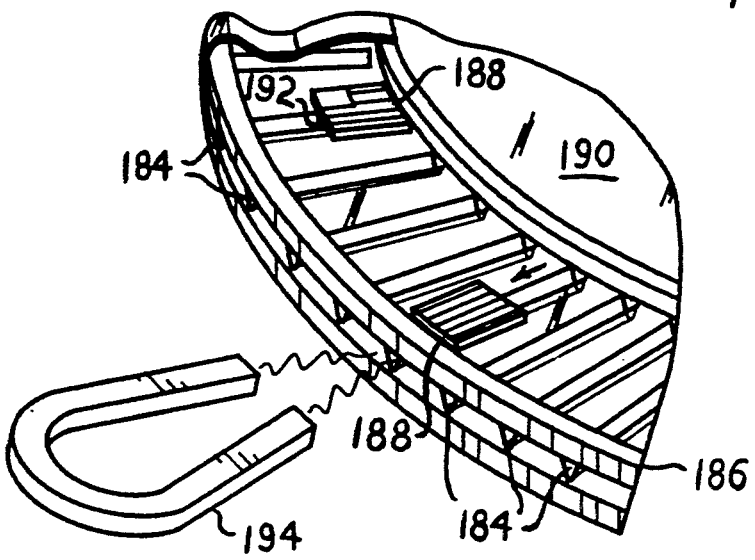
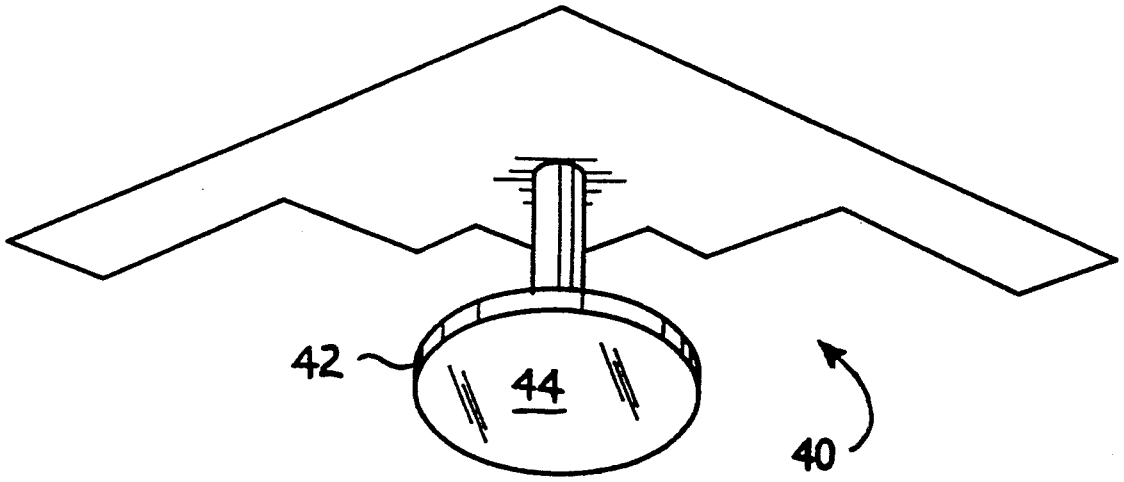
FIG. 5A

BANKERS TAB SHEET

| GREEN PLAYER | BLUE PLAYER | WHITE PLAYER | RED PLAYER | YELLOW PLAYER | BLACK PLAYER |
|---|---|---|---|---|---|
| | | | | | |
| | | | | | |

BOARD GAMES OF GLOBAL CONQUEST

FIELD OF THE INVENTION

The present invention relates generally to board games, and more specifically to embodiments of a game based upon a political map of the globe and providing for the movement of playing pieces and subsequent conquest of political areas of the board, based upon the players' knowledge of the areas in question.

BACKGROUND OF THE INVENTION

With the increasing complexity of the modern world, many persons have difficulty in staying abreast of the various political situations occurring throughout the world. While doing so may be time consuming (i.e., reading the paper and watching televised news programs, etc.), most of these current affairs presentations neglect to provide background to any significant depth about the nation or area in question. This information is important for a complete understanding of the world situation. However, the conventional means for attaining such knowledge via books, etc., is generally not particularly enjoyable to most persons.

It is noted that innumerable games have been developed in the past to fill the leisure hours of people, with many of these games being board games. However, these games generally do not stress or require a need for knowledge of the world situation or of the general economic or other aspects of various nations or regions of the globe. Consequently, the need arises for games which provide an enjoyable and competitive means of learning about the various nations of the globe, and simulating control or conquest of those areas through knowledge of the areas and playing skill.

DESCRIPTION OF THE PRIOR ART

U.S. Pat. No. 2,347,094 issued to Philip C. Fernandez on Apr. 18, 1944 discloses a Game having a map of the earth with the major continents depicted; individual nations are not depicted, as in the present games. Spaces for playing pieces are provided in rectangular areas within the continents, unlike the present games. The Fernandez game is dependent upon chance in the random drawing of the playing pieces by the various players, whereas the present games do not use any chance means, but rely upon the skill of the players in the play of their playing pieces and the knowledge of the players required for success in the games. No game components other than the board and position markers are disclosed by Fernandez, whereas the present game embodiments utilize a number of different components for various aspects of play.

U.S. Pat. No. 3,064,979 issued to Lawrence P. Ralston on Nov. 20, 1962 discloses a Game using a board depicting a part of the global surface. The board includes a grid, providing for the interlocking connection of a series of wall pieces thereacross, unlike the present games. Positioning of the wall pieces is determined by chance, unlike the area conquest provided for in the present games, wherein skill in the play of the pieces or markers is required, as well as knowledge of the area in question.

U.S. Pat. No. 3,948,524 issued to Robert B. Ladd et al. on Apr. 6, 1976 discloses a Game Apparatus having a board with no geopolitical areas depicted; only a grid is disclosed. The object is to capture areas of the board with playing pieces, with the placement and order of play determined by chance drawing of cards. As noted above, the outcome of the present games do not depend upon chance, but rather on the skill and knowledge of the players.

U.S. Pat. No. 4,029,321 issued to Charles G. Lang, Jr. on Jun. 14, 1977 discloses a Card and Board Map Game including a polar projection of the geopolitical areas of the globe on a circular board. A plurality of radial zones are marked on the board, with each player being assigned one or more zones. Cards are randomly dealt to the players, with the cards designating different areas or nations. The chance element provided by the random dealing of the cards is unlike any aspect of the present game. The present game includes a rotary upper portion to displace playing pieces already played, but also includes movable peripheral markers to designate nations already played, unlike the Lang, Jr. game.

U.S. Pat. No. 4,736,954 issued to Christopher Haney et al. on Apr. 12, 1988 discloses a Question and Answer Game having a board with a depiction of the continents thereon, with an overlying hexagonal pattern. Cards are provided with questions thereon, which players must answer. However, chance means are used to determine the category of the question and the degree of difficulty, unlike the present game.

Finally, U.S. Pat. No. 5,085,439 issued to Willie C. Lott on Feb. 4, 1992 discloses a Game Board, Query Cards, and Method of Playing A Black History Game. Chance means (dice) are used to determine the board positions for the players, unlike the present game. Scoring points are awarded by chance, according to the number rolled with the dice. The score required to win the game is variable, increasing yearly as time advances from the date of the Emancipation Proclamation of 1863.

None of the above noted patents, taken either singly or in combination, are seen to disclose the specific arrangement of concepts disclosed by the present invention.

SUMMARY OF THE INVENTION

By the present invention, improved board games of global conquest are disclosed.

Accordingly, one of the objects of the present invention is to provide improved board games which include a circular board configuration having a global geopolitical map thereon, with at least one embodiment including lighting means therein controllable by the players of the game.

Another of the objects of the present invention is to provide improved board games which include a plurality of playing pieces of different types, with the different types being restricted to moves and to areas of the board simulating military equipment and personnel.

Yet another of the objects of the present invention is to provide improved board games which include movable components peripherally disposed about the boards, which components designate conquered or unconquered areas of the boards.

Still another of the objects of the present invention is to provide improved board games each of which include a rotatable center area upon which the playing pieces are positioned, and which provide for the displacement of the playing pieces to incompatible areas of the boards.

A further object of the present invention is to provide improved board games which may include magnetic means for the operation of peripheral components.

An additional object of the present invention is to provide an improved method of playing board games which includes at least one playing piece per player which is not placed upon the board, but which position is known only to the controlling player.

Another object of the present invention is to provide an improved method of playing board games which provides for the shifting of at least some of the playing pieces to areas of the board which are incompatible with their characteristics, thereby causing the loss of those playing pieces.

Yet another object of the present invention is to provide an improved method of playing a board game which may include the placement and removal of playing pieces from the board more than once during the course of play.

Still another object of the present invention is to provide an improved method of playing board games which required a player to answer correctly questions relating to the area of the board which the player has conquered or captured by play of his or her playing pieces, and which answers may be subject to an escalating series of challenges by other players.

A final object of the present invention is to provide improved board games and a method of play thereof for the purposes described which is inexpensive, dependable and fully effective in accomplishing its intended purpose.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

FIG. 4 is a broken away perspective view of a peripheral portion of the game board of FIG. 3, showing the magnetic means of moving the radially movable national tabs captured within the periphery of the game board.

FIG. 5A is a lower perspective view of a stealth playing piece of the present game, showing the writing surface thereunder.

Similar reference characters denote corresponding features consistently throughout the several figures of the attached drawings.

DETAILED DESCRIPTION OF THE PREFERRED EMBODIMENTS

Figure 1:
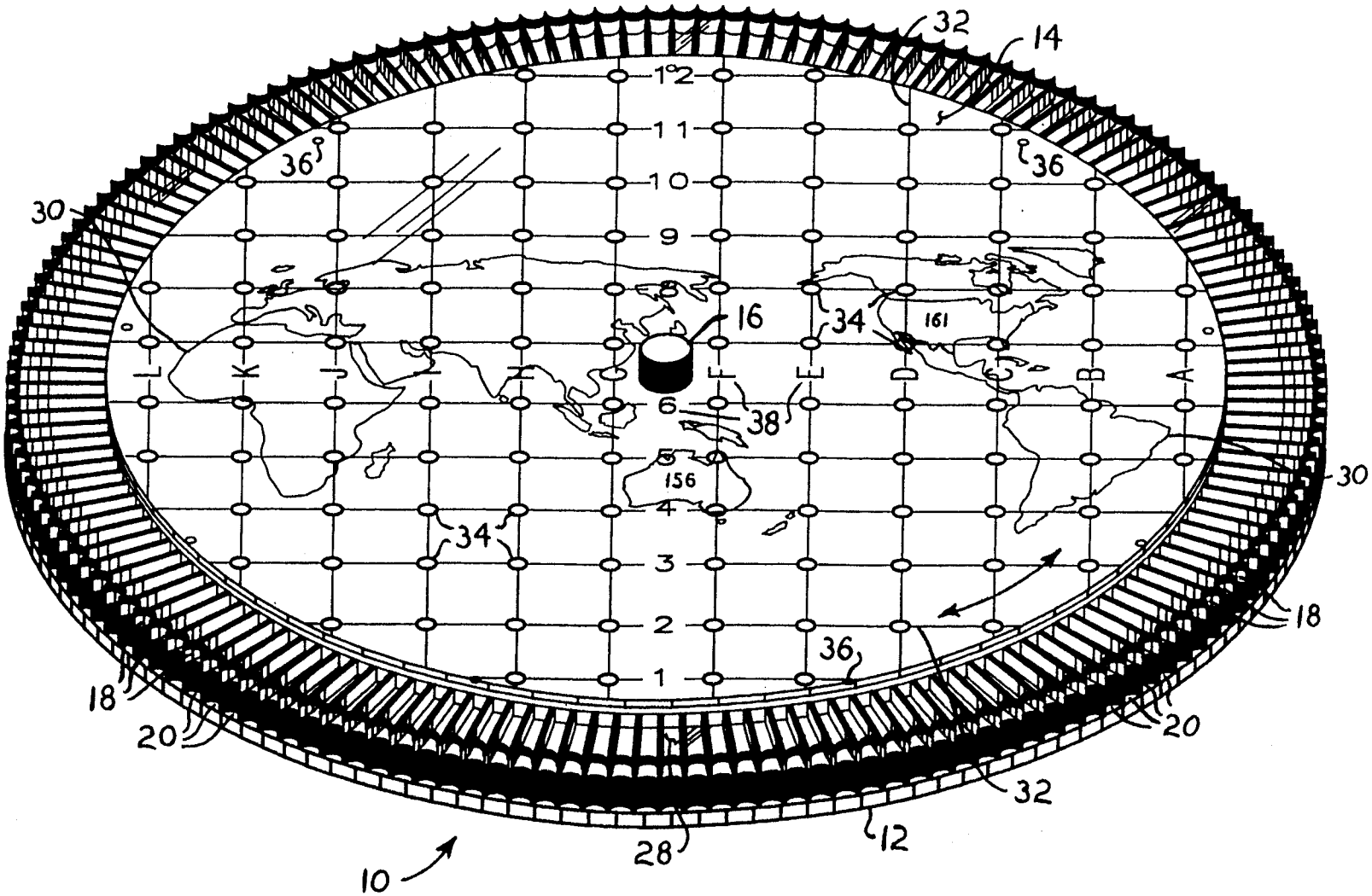
FIG. 1 is a perspective view of the game board of the first embodiment of the present game, showing its features.

Referring now to the drawings, the present invention will be seen to relate to two embodiments of a board game simulating the conquest of various areas of the globe. FIG. 1 discloses a perspective view of the game board 10 of the first embodiment, relating to a manually operated game without electronic or other powered means therein. The game board 10 comprises a generally circular base portion 12, with a circular rotatable transparent sheet 14 overlying the upper surface of the base portion 12. A central knob or fixture 16 may be used to secure the transparent sheet 14 in place upon the stationary base portion 12.

Figure 2A:
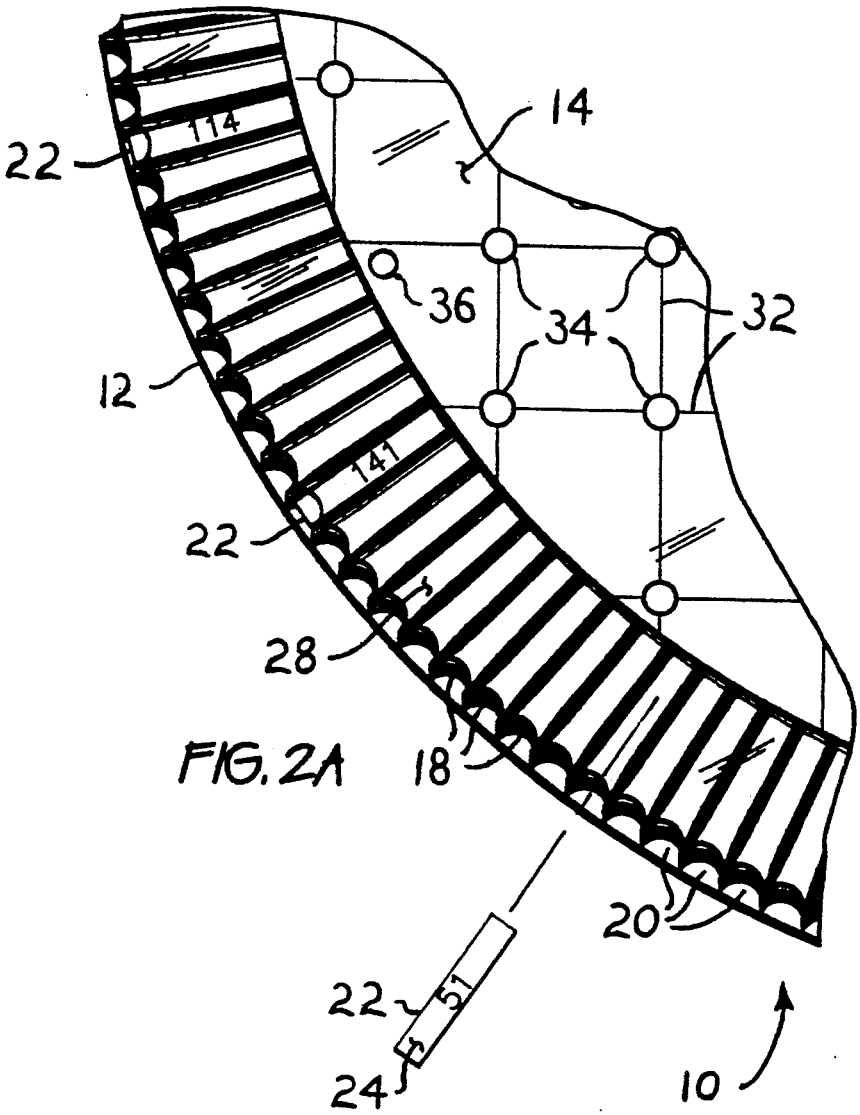
FIG. 2A is a broken away perspective view of a peripheral portion of the game board of FIG. 1, showing the detail of the removable insertion of the national tabs used in the game.

The stationary or fixed base portion 12 includes a plurality of radially disposed peripheral slots 18 thereround, more clearly shown in the broken away detail view of the rim of the game board shown in FIG. 2A. Preferably, one slot 18 is provided for each nation of the globe. The present embodiments include 162 slots 18, providing for 162 different nations. The precise number of slots, and the corresponding number of nations used in the play of the present game, may be adjusted from time to time to allow for newly independent nations being formed or the consolidation of different nations to form a single nation, etc. Each of the slots 18 may include a semicircular concave inset 20, providing for the gripping of tabs 22 disposed within the slots 18 for the withdrawal thereof during the play of the game.

Figure 2B:
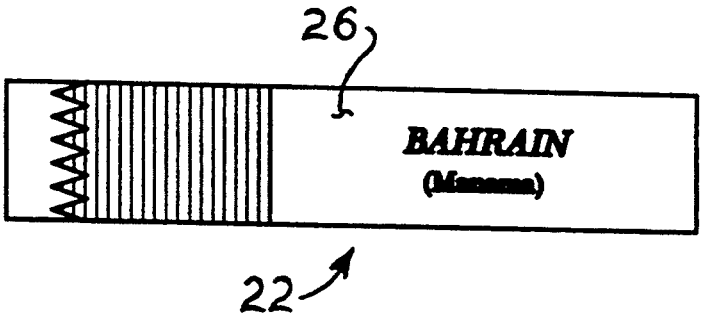
FIG. 2B is a plan view of the back side of one of the national tabs used in the present game.

The slots 18 each provide for a separate, distinct nation tab 22 to be removably disposed therein, more clearly shown in FIG. 2A. Each nation tab 22 includes a numbered first surface 24 and an opposite second surface 26 (FIG. 2B), including at least the name of a nation corresponding to the number on the opposite first side 24. The tabs 22 may include additional information relating to the named nation thereon, such as the flag of the nation and the national capitol, if desired, as shown on the second surface 26 of the tab 22 of FIG. 2B. Preferably, 162 nation tabs 22 are provided, with one tab 22 being removably installed in each of the slots 18. The tabs 22 are preferably removably installed in numerical order with their numbered first surfaces 24 facing upward within the slots 18 and visible through a transparent peripheral cover 28. The nations named on the second surface 26 are not necessarily in alphabetical order corresponding to the numerical order of the first surface 24, for reasons explained further below.

The central area of the base portion 12 includes a geopolitical map 30 of the globe thereon, visible through the overlying transparent rotatable sheet 14 thereabove. The map 30 includes representations of the corresponding nations (preferably 162, in the present embodiments) listed on the second surfaces 26 of the numbered nation tabs 22, with each nation on the map 30 being assigned a number corresponding to the number of its specific national tab 22. Most of the national outlines and numbers have been omitted for clarity in the drawings, but examples are shown for the United States (no. 161) and Australia (no. 156). It will be understood that each of the nations will be outlined on the map 30 and will have a number assigned and displayed thereon, with that number corresponding to the specific numbered national tab 22 for that nation.

The rotatable transparent sheet 14 overlying the base portion 12 and map 30, includes a rectilinear grid 32 thereon. At each intersection point on the grid 32, an intersection marked 34 is provided for the positioning of a player position marker or playing piece, as will be described further below. The rotatably disposed transparent sheet 14 provides for the rotation of the grid 32, including any playing pieces thereon, to change the positions of the playing pieces relative to the map 30 visible thereunder during the play of the game. A plurality of rotation index markers 36 (preferably nine, evenly spaced every 40 degrees about the map 30 periphery) is provided on the map 30, to allow the realignment of the grid 32 (and any playing pieces thereon) relative to the underlying map 30 during the play of the game, as will be explained further below. The grid 32 also includes an alphanumeric index 38 thereon providing for the description of the location of playing pieces.

Figure 5C:
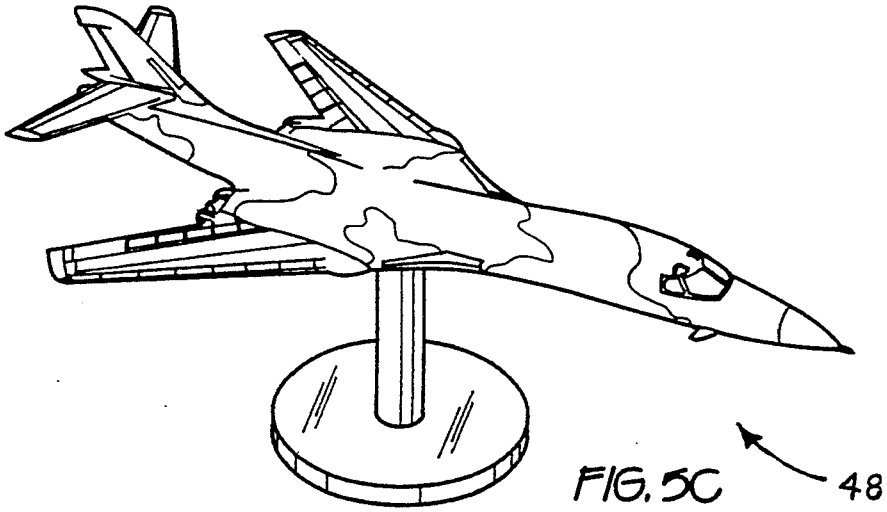
FIG. 5C is a perspective view of a bomber playing piece of the present game.

FIGS. 5A through 5H disclose the various types of player position markers used in the play of the present games. FIG. 5A discloses a "stealth" playing piece or player position marker 40, which includes a depending base 42 having a smooth bottom surface 44 thereunder adapted to accept written notations applied thereto. The stealth piece 40 is unique in that it is never positioned on the transparent sheet 14 or grid 32 of the game board 10. Rather, each player controlling a stealth piece 40 retains it to the side of the game board 10 and notes its "stealth" location on the bottom surface 44 of the base 42. This "stealth" position is known only to the player controlling that stealth piece 40, with the position being unknown to the other players of the game. A stealth piece or marker 40 is permitted to occupy and/or to move to (in "stealth" mode, as described above) any position on the grid playing surface defined by one of the grid 32 intersections and corresponding intersection marks 34, which is not already occupied by another playing piece according to the rules described further below.

Figure 5B:
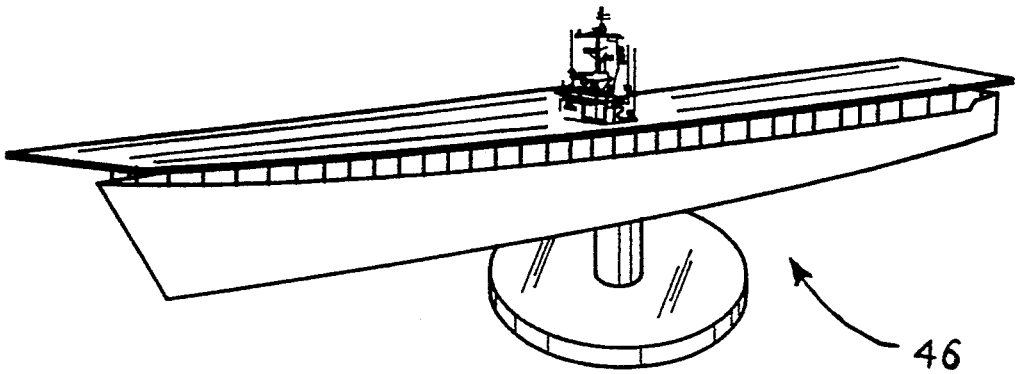
FIG. 5B is a perspective view of an aircraft carrier playing piece of the present game.

FIG. 5B represents an "aircraft carrier" playing piece or position marker 46. The aircraft carrier marker 46 may be positioned on and be moved to any grid 32 intersection point on the rotatable playing surface sheet 14, so long as it is positioned on water and not on land. Examples of permitted positions for an aircraft carrier position marker 46 are intersections H-4, H-5, I-4, and 1=5 of FIG. 1, representing the Indian Ocean area of the map 30. Prohibited locations would be G-7, G-8, H-7, and H-8, which intersections overlie the land mass of eastern Asia. (Again, the transparent sheet 14 with its overlying grid 32 may be rotated during play to move the locations of the grid 32 intersections relative to the water and land areas, as will be explained later.) The aircraft carrier marker 46 is unique in that it may also control and adjacent rectilinear grid intersection over either a land or water area of the map 30, just as a real aircraft carrier may send out aircraft to cover a land or water area beyond the carrier. The only restriction on such multiple position coverage is that the second position not already be claimed by another marker from either the same or another player. The aircraft carrier marker 46, just as with other markers restricted to either land or water areas, may move across any type of area so long as its comes to rest upon a compatible area (water, in the case of the aircraft carrier marker 46).

FIG. 5C discloses a conventional bomber position marker 48. This marker 48 is played conventionally on the rotatable transparent playing surface 14 and its grid 32, in the manner of the aircraft carrier marker 46 discussed above. However, its movement is restricted to a maximum of ten spaces (grid intersections) over the map 30, once it is positioned on the grid 32. (Initially, any of the playing pieces may be placed on any legal position on the grid 32, to start the game. Restriction of marker movement only applies to markers already positioned on the grid 32.) The bomber marker 48 may move across water areas of the grid 32, so long as the end point of the move is over a land area.

Figure 5D:
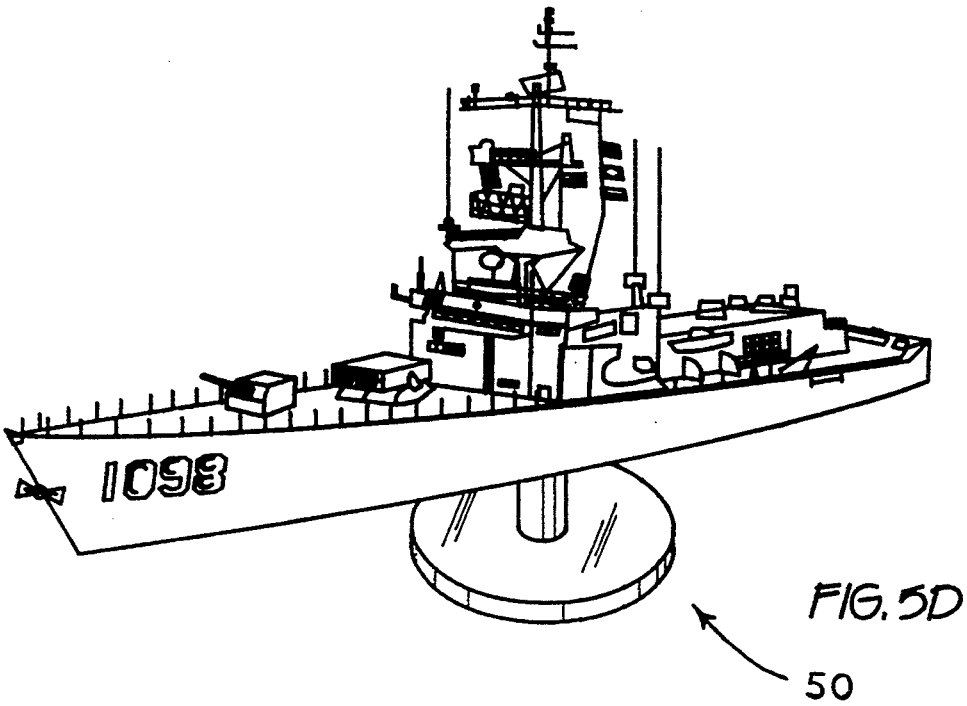
FIG. 5D is a perspective view of a battleship playing piece of the present game.

FIG. 5D discloses a "battleship" marker 50. The battleship playing piece or position marker 50 may initially be placed upon any grid 32 intersection overlying a water area of the underlying map 30, and is restricted to a maximum movement of ten spaces over the water areas of the map 30; movement over any land areas is permitted, so long as the battleship marker 50 comes to rest upon an intersection over a water area of the map 30.

Figure 5E:
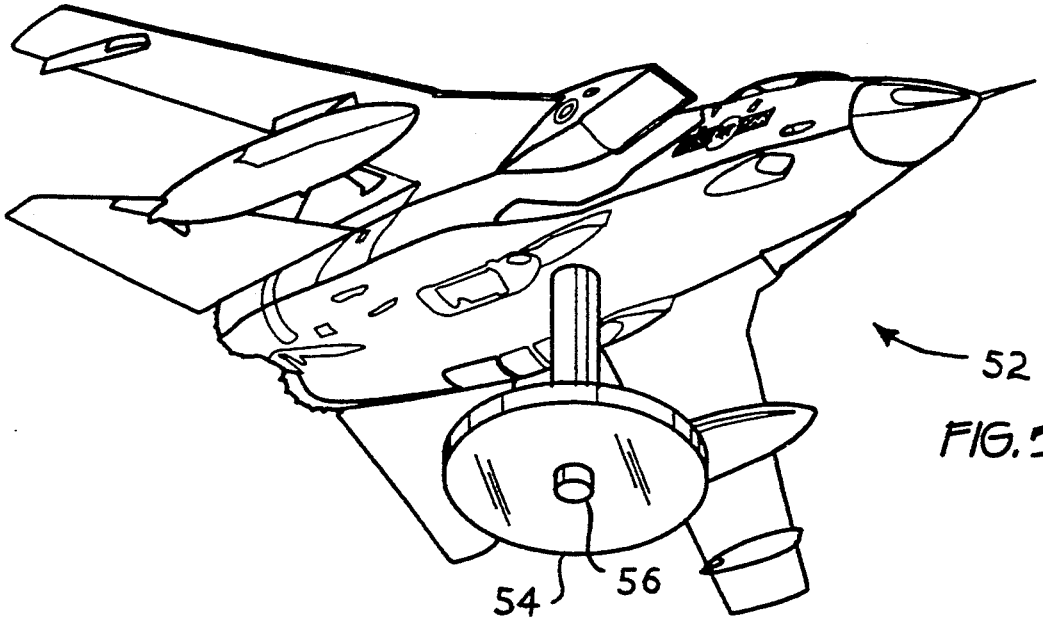
FIG. 5E is a lower perspective view of a fighter aircraft playing piece of the present game, showing the peg means for placement of the game board of the second embodiment.

FIG. 5E discloses a "fighter" type marker 52. The fighter position markers 52 are restricted to land areas, and may only move a maximum of five grid 32 intersection spaces or positions (e.g., J-5 to J-7, and thence to G-7 in FIG. 1) once placed upon the playing grid 32. (Playing pieces may not move diagonally.) It will be noted that the underside of the base position 54 of the fighter marker 52 includes a peg 56 extending downward therefrom, which peg 56 provides for the secure positioning of the fighter marker 52 over a cooperating grid intersection hole, as described further below in the discussion of the second embodiment. It will be understood that such pegs 56 may be deleted from any of the various playing pieces described for use with the first embodiment of the present games, or that alternatively any of the player position markers described herein (with the exception of the "stealth" marker 40, with its requirement for a smooth undersurface 44) may be equipped with pegs 56 for use with a playing surface containing peg holes therein, as in the second embodiment.

Figure 5F:
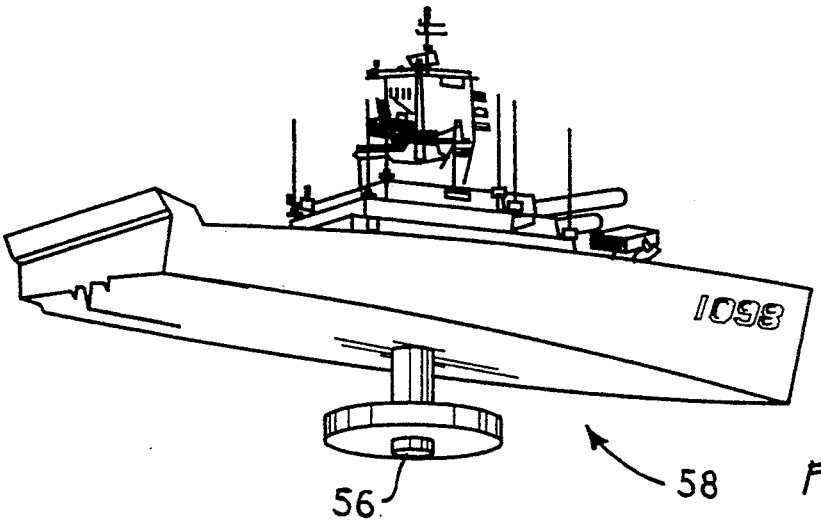
FIG. 5F is a lower perspective view of a destroyer playing piece of the present game, again showing the peg retention means.

FIG. 5F discloses a "destroyer" player position marker 58. The destroyer marker 58 is limited to placement over the water areas of the map 30, as in the case of the other naval type markers 46 and 50 described above. Movement is limited to no more than five spaces, but may be across an intervening land area of the map 30, as in the other markers 46 and 50, so long as the end position of the destroyer marker 58 is over a water area of the map 30. It will be noted that the underside of the destroyer player position marker base also includes a peg 56 extending downward therefrom and providing for the secure positioning of the marker 58 on a holed playing surface, as described above for the fighter position marker 56 and provided for the other markers as required.

Figure 5G:
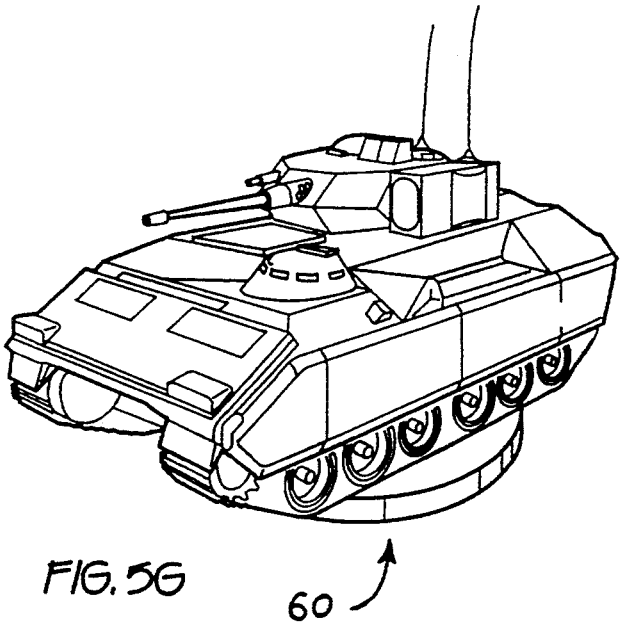
FIG. 5G is a perspective view of a tank playing piece of the present game.

FIG. 5G is a drawing of a "tank" marker 60. Tank player position markers or pieces 60 are limited to a maximum movement of five positions (grid intersections) over the land areas of the map 30 displayed through the sheet 14. Again, movement across water areas is permitted, so long as the final position for the move is over a land area of the map 30.

Figure 5H:
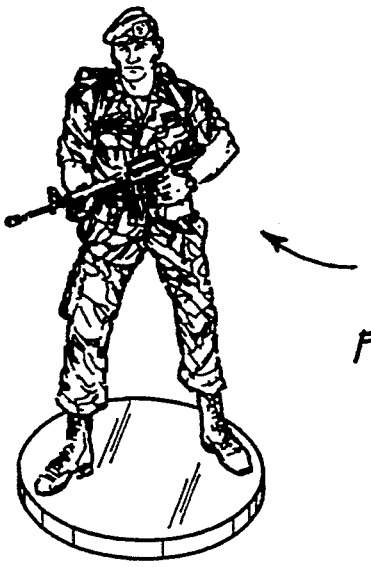
FIG. 5H is a perspective view of a foot soldier or infantry trooper playing piece of the present game.

Finally, FIG. 5H discloses a trooper or infantry foot soldier player position marker 62. The trooper markers 62 have the most restricted movement, being limited to a single space or position on land. As such, it will be seen that they cannot cross extensive water areas, but are limited to portions of the grid 32 having adjacent intersection marks 34 for the positioning of the markers, which are both disposed over land at the time of the move.

Figures 6, 7:
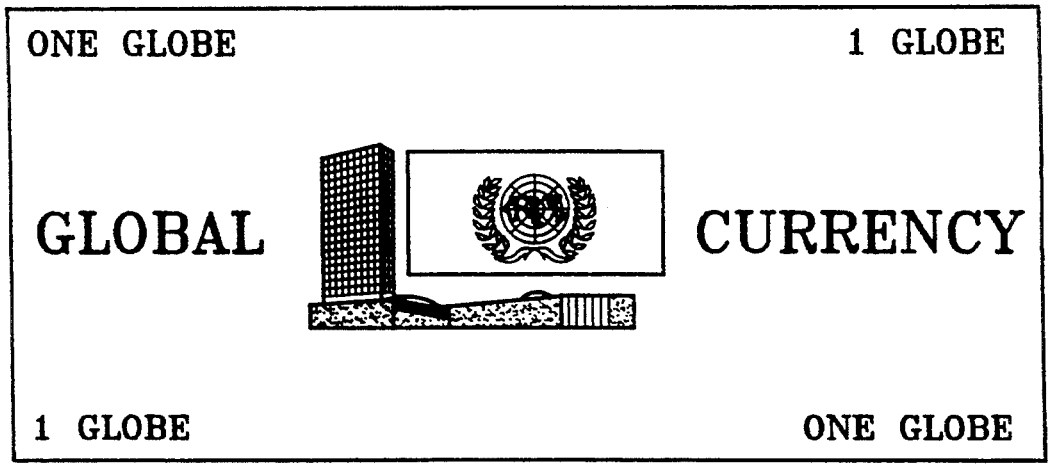
FIG. 6 is a plan view of one of the denominations of simulated currency used in the play of the present game.
FIG. 7 is a plan view of the score sheet used in the play of the present game.

The present game is played according to the steps described in the flow chart of FIGS. 9A through 9E. The present game utilizes a simulated currency 64 (FIG. 6, called "globes") as a medium of exchange during the play of the game, and in fact the object of the game is to acquire the greatest simulated wealth in globes 64 of various denominations. (It will be understood that the "1 globe" showing in FIG. 6 is representative of various different denominations simulating comparable different denominations of real currency; other simulated denominations are not shown in order to reduce the number of drawing figures required.) As simulated currency exchange between players and the game "bank" is an ongoing process during play, a bankers tab sheet 66 is provided in order to maintain a record of the simulated financial status of each player. While not required, it may be more efficient for a non-player to act as banker or scorekeeper, as indicated in the first step 68 of FIG. 9A, in order for the banker to avoid the distraction of play.

Figure 9A:
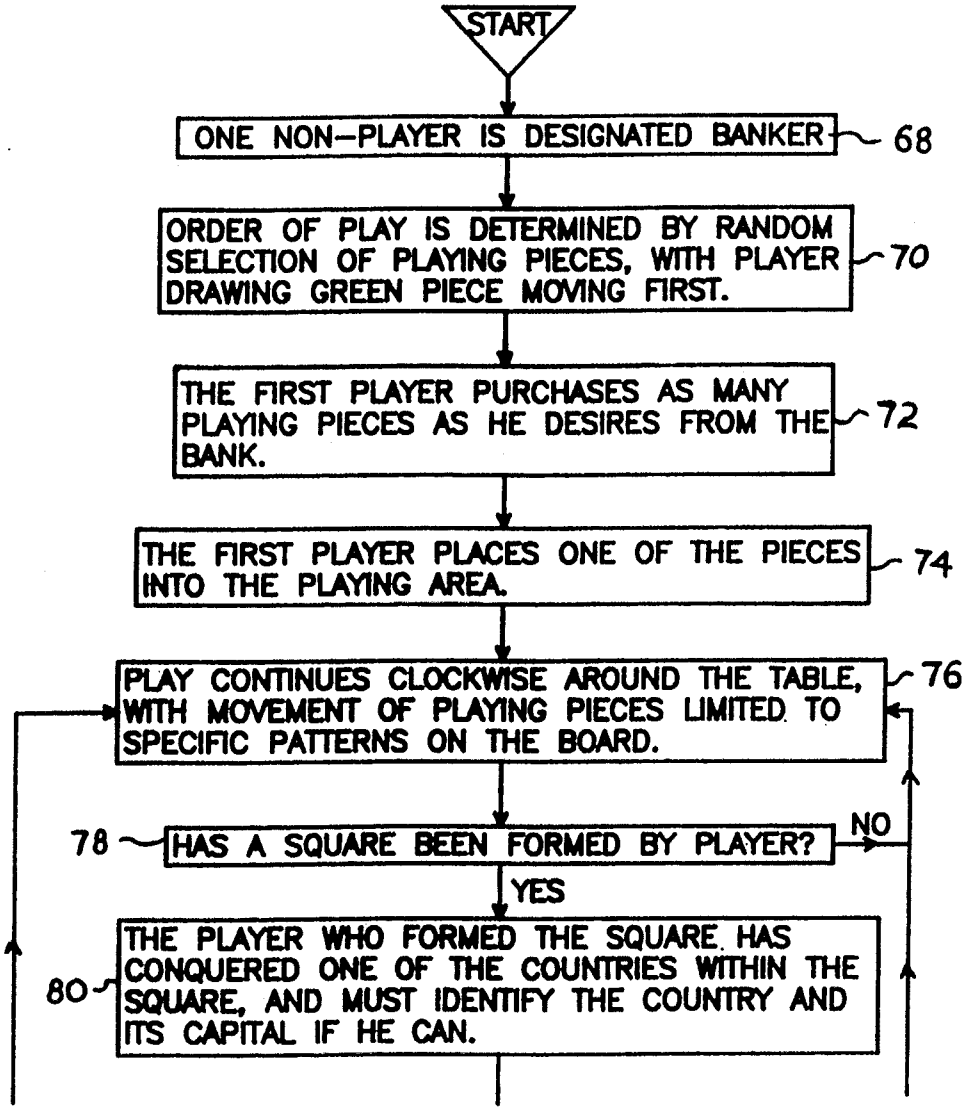
FIGS. 9A through 9E show a flow chart describing the steps involved in the method of play of the two embodiments comprising the present game.

Next, the order of play is determined among the two to six players of the game, as indicated in the second step 70 of FIG. 9A. (The singular term "player" may include a group of two or more persons acting as a team.) The players may position themselves around the game board 12 in whatever order they wish. While other methods of determining the order of play may be used, it has been found that the color coding of the pieces or markers for each of the players may be used, with the banker selecting at least one green colored playing piece and equivalent opposing playing pieces of different colors. The player who blindly selects the green playing piece is assigned the playing pieces or markers of that color, with play proceeding clockwise around the board 12 from there.

At this point, each player must determine the initial playing pieces he/she wishes to control, and purchase those pieces from the bank, as indicated in the third step 72 of FIG. 9A. It will be noted that no currency is provided to the players at the start of the game; each player is in debt to the bank after purchasing one or more playing pieces. The banker makes not of the respective debts of each player on the tab sheet 66. Each player may purchase as many pieces as he/she wishes from the bank. However, it is possible during the course of the game for one or more of those pieces to be lost back to the bank, as will be described further below. Moreover, a player can sell any of the pieces back to the bank, but will receive only one half the purchase price. Hence, a player may not wish to purchase large numbers of markers, or many of the more costly markers, early in the game. Each player has available to him/her one stealth marker 40, one aircraft carrier marker 46, and four of each of the other markers.

As each type of marker is provided with different ranges and powers, it will be seen that the more powerful markers are inherently more valuable. Accordingly, the present game assigns higher prices to those more valuable markers. The stealth marker 40 is assigned a value of 500 globes; the aircraft carrier 46, 200 globes; the conventional bomber 48 and battleship 50 markers, 20 globes each; the fighter marker 52, 15 globes; the destroyer 58 and tank 60 markers, 10 globes each; and the trooper marker 62, a value of 5 globes. While the above described number of playing pieces or markers, and their values, are preferable for the play of the present game, other numbers of markers and different values may be assigned as desired.

As this point, the first player (who has drawn assignment of the green markers or pieces) places one of his/her markers on the rotatable transparent sheet 14 comprising the playing surface of the game 12, on an intersection of the grid 32, over an underlying water or land area of the map 30, depending upon the type of marker and accompanying restrictions on placement thereto. The marker may initially be placed on any legal position on the sheet 14, with no restriction as to distance from the periphery of the sheet 14. Subsequent moves are restricted as described above in the discussion of the individual markers. (Alternatively, the first player may purchase a stealth marker 40 and make a notation on the bottom surface 44 of the base 42 thereof, concealing the stealth move from all other players.) Other players may then sequentially place their markers as desired, with the order of play proceeding clockwise around the table and each player making one move at a time, as described in the fifth step 76 of FIG. 9A.

The initial object of the game is for each player to form a square pattern of any size on the playing surface 14, which square pattern at least partially encompasses at least one of the nations forming the map 30. As an example, a square pattern may be formed by the placement of one player's markers on the intersections B-4, B-10, H-4, and H-10 of FIG. 1, thus forming a square six by six matrix of the grid 32 intersections and intersection marks 34 therein, with the United States (as well as many other nations) wholly or partially contained within the square thus formed. Another example might be a smaller square formed of pieces on the intersections F-5, F-6, G-5, and G-6, which will be see to include a small portion of the Northern Territories of Australia, as well as various Indonesian island nations. As described above in the discussion of the movement of the various markers, as few as two markers need be physically placed on the board 12: An aircraft carrier marker 46 may control an additional intersection adjacent to its physical position, and a stealth marker 40 may control a position while not being physically located on the board.

Assuming that no square has been formed by a player, as provided for in one of the alternatives of the sixth step 78 of FIG. 9, play continues with a return to the previous fifth step 76 as shown by the directional arrows of FIG. 9A. However, assuming that a square has been formed by a player, as indicated in the seventh step block 80, the player is considered to have "conquered" at least one of the countries which is at least partially included within the square formed, and must identify one of the nations at least partially contained within the square in order to be rewarded. The reward is doubled if the conquering player is also able to name the capitol of the conquered nation.

Figure 9B:
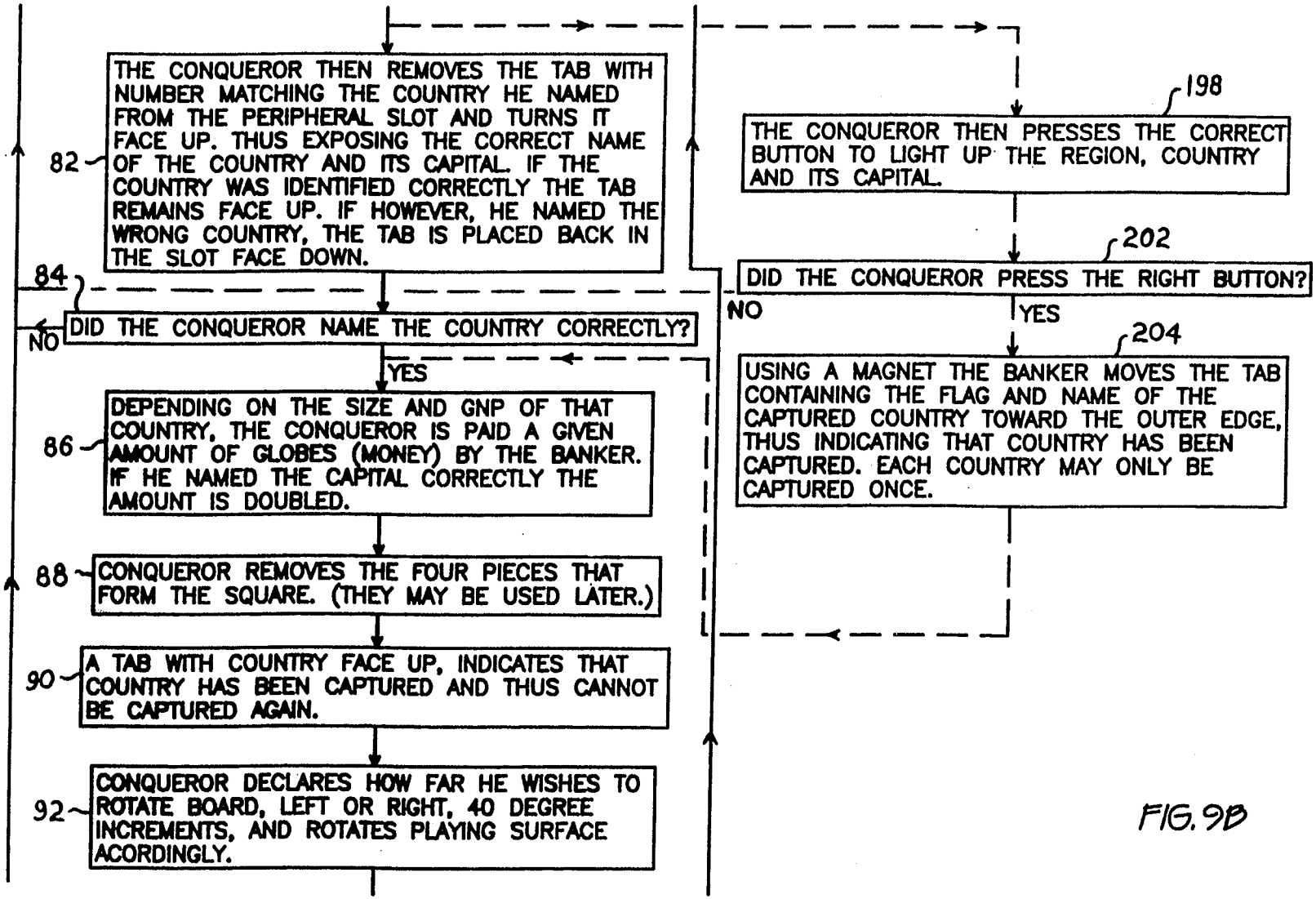

One of the players (or the banker) then withdraws the numbered nation tab 22 corresponding to the number of the conquered nation (e.g., the tab 22 having the number 156 on the first surface 24 thereof for Australia, which is also designated as nation no. 156 in FIG. 1) and turns it over, to display the name of the nation and its capitol on the opposite second side 26 of the tab 22, as indicated by the eighth step 82 in the method of play of FIGS. 9A through 9E, shown at the top of FIG. 9B. Assuming the conquering player was correct in at least his/her identification of the nation, as provided in one of the alternatives of the ninth step 84 shown in FIG. 9B, the player is rewarded, as indicated in the tenth step 86, FIG. 9B, and the tab 22 is returned to its appropriate slot 18 with the name of the nation and capitol facing upward. If the player was incorrect in his/her identification of the conquered nation, no reward is p aid, the nation tab 22 is returned with the numbered side 24 facing upward to its appropriate slot 18 in the periphery of the game board 12, and play reverts to the fifth step 76 of FIG. 9A.

The reward comprises a payment from the bank to the conquering player, in globes, and is variable, depending primarily upon the gross national product and wealth of the nation. As an example, a conquering player claiming the United States and correctly identifying the nation, would be awarded 200 globes. The conquest of Australia, on the other hand, would be valued at 80 globes, due to is smaller wealth and gross national product. Again, the reward is doubled for the correct identification of the capitol of the conquered nation, as indicated in the tenth step 86, FIG. 9B. The standard reward is provided if the conquering player has identified the nation but fails to identify its capital correctly.

Assuming a correct identification of the nation has been made, the conquering player removes his/her pieces/markers which were used to form the square, from the board 12, as indicated by the eleventh step 88 of FIG. 9B. The player retains these pieces for later use. As indicated above, the nation tab 22 is displayed in its slot 18 in the periphery of the board 12 with the name of the nation and capitol facing upward and may not be conquered again by another player in the course of the game, as indicated by the twelfth step 90 of FIG. 9B.

A conquering player who correctly identifies the conquered nation also enjoys another privilege: He/she may rotate the rotatable transparent playing surface 14 and grid 32 thereon overlying the map 30, to a different orientation relative to the map 30, as desired. This is indicated in the thirteenth step 92 of FIG. 9B. This rotation is done in one ore more 40 degree increments, as determined by the conquering player. The nine rotation index markers 36 on the map 30 (FIG. 1) are used to realign the grid 32 and rotatable playing surface 14 at the desired 40 degree increment(s) of rotation. When this step is completed, the various playing pieces or markers which have been placed upon the grid 32 of the rotatable playing surface 14, will be displaced from their original positions relative to the land masses and water areas of the map 30. For those pieces restricted to land masses (e.g., fighter 52, trooper 62) or water area (e.g., battleship 50, destroyer 58), any resulting shift to an incompatible area will result in the confiscation by the bank, with no compensation to the player of those pieces. The player must repurchase those pieces as desired, at the full price, on a subsequent turn, as indicated by the fourteenth step 94 of the flow chart, FIG. 9C.

At this point, the game enters a question and answer phase to challenge the conquering (and perhaps other) player's knowledge of the conquered area. This question and answer phase is optional to all players, including the conquering player, However, successful answers (i.e., those which go unchallenged, whether correct or not) result in payment to the successful respondent. The banker acts as the questioner, and begins by asking the conquering player a question relating to the conquered nation, and chosen from a question sheet containing questions (and the correct responses) about the nation. An example of such a question and answer sheet is shown below.

AUSTRALIA Conqueror's Award Fee—80 Globes

Q. What is the geographic area of Australia?
(1) 3,000,000 square miles,
(2) 6,000,000 square miles,
(3) 9,000,000 square miles A. (1) 3,000,000 square miles Q. What is the population of Australia?
(1) 8,400,000,
(2) 12,900,000,
(3) 16,700,000

A. (2) 16,700,000

Q. What is the official language of Australia?

A. English

Q. What are the three predominant religions in Australia?

A. Anglican, Protestant, and Roman Catholic

Q. What type of government does Australia have?

A. Democratic, federal state system

Q. What is the monetary unit in Australia?

A. Australian dollar

The above questions and responses comprise a sample and are typical of those supplied for each of the 162 nations of the present game. More questions relating to major industries, crops, famous personalities, well known geographical features, native plants and animals, etc., may be provided as desired, in order to provide a well rounded overview of the nation in question.

Figure 9C:
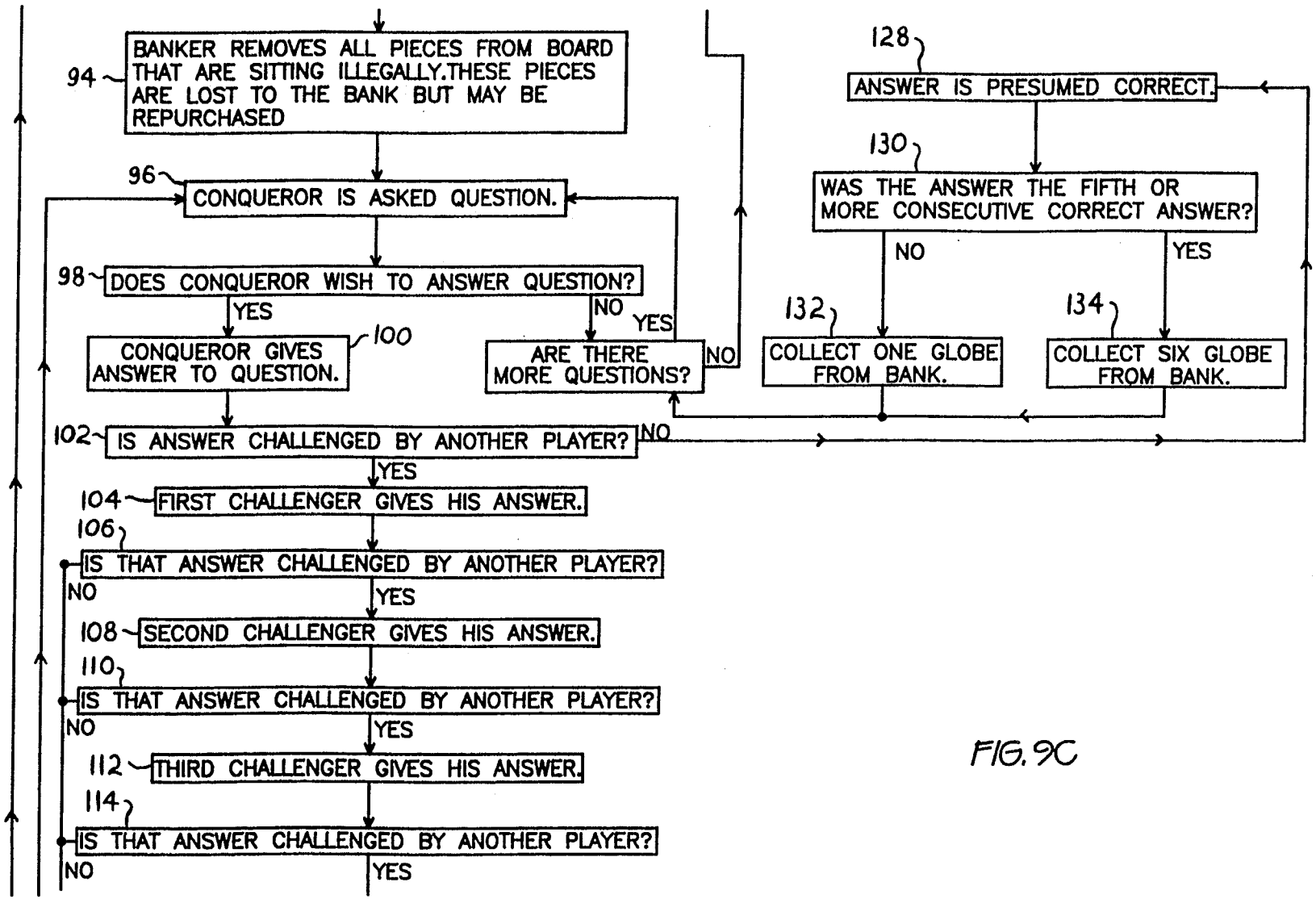
Figure 9D:
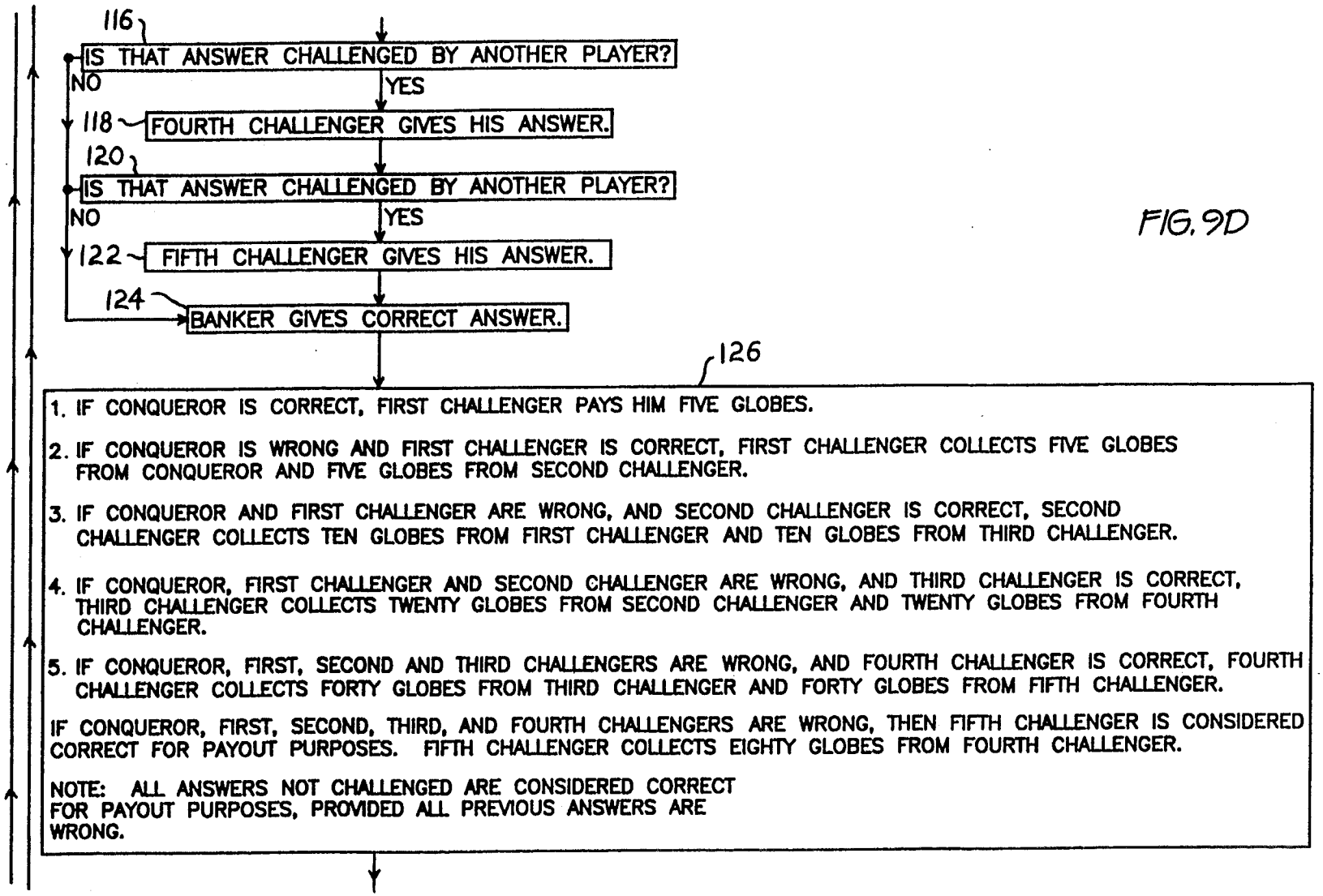

The phase begins with the banker asking the conquering player the first question on the question list relating to the conquered nation, as indicated in the fifteenth step 96, FIG. 9C. A response to the question is optional, as indicated by the sixteenth step 98, FIG. 9C. If the conquering player declines to answer the question, the banker reads the next question on the sheet, and so on until either no questions remain, or the conquering player answers a question. No other players are allowed to challenge if the conquering player declines to answer, as there is no answer to challenge.

However, assuming the conquering player provides a response, as indicated in the seventeenth step 100, FIG. 9C, the response may be challenged by another player (eighteenth step 102, FIG. 9C). Note that no determination is made at this point as to the accuracy of the response to the question; the correct answer is not provided until all challenges have been made, as described below. The first challenging player then provides his/her response (nineteenth step 104), whereupon that response may be challenged by yet anther player (twentieth step 106), and so forth, continuing through possible challenges and responses by second through fifth challenging players (which may or may not be in consecutive order around the board 12), as indicated respectively in the twenty first through twenty eighth steps 108 through 122 of FIGS. 9C and 9D.

Then this escalating challenge and response phase has been completed with no further challenges being issued, the banker reads the correct response (twenty ninth step 124, FIG. 9D), whereupon the correct respondent is rewarded according to the thirtieth step 126. The bank does not provide any payment to any of the players under this escalating challenge system; the only bank payout is to the conqueror, assuming that the conqueror's answer is not challenged. All challenged responses result in payment from the conqueror or challenger to the last unchallenged respondent, whether correct or not. If either the conqueror or the first challenger are correct, the incorrect player will pay the correct player five globes. The payment escalates from that point, according to the number of challenges issued, with payment doubling for each additional challenge. Payment is only made from the two challenging players immediately before and immediately after the player providing the correct answer, to the correct player, e.g. if the fourth challenger is correct, then he/she is paid forty globes each from the third and firth (if any) challenger(s).

The above applies only when a challenge is made to a response by a conquering player. If no challenge is made, the conqueror's answer is presumed to be correct, as indicated by the thirty first step 128 of FIG. 9C. The conqueror may answer several questions, as indicated by the thirty second step 130, FIG. 9C. Unchallenged responses by the conquering player to the first four questions, result in a payment from the bank to the conqueror of one globe for each response; thirty third step 132, FIG. 9C. However, unchallenged responses to give or more questions result in a high payoff of six globes from the bank to the conqueror, as indicated in the thirty fourth step 134 of FIG. 9C.

Figure 9E:
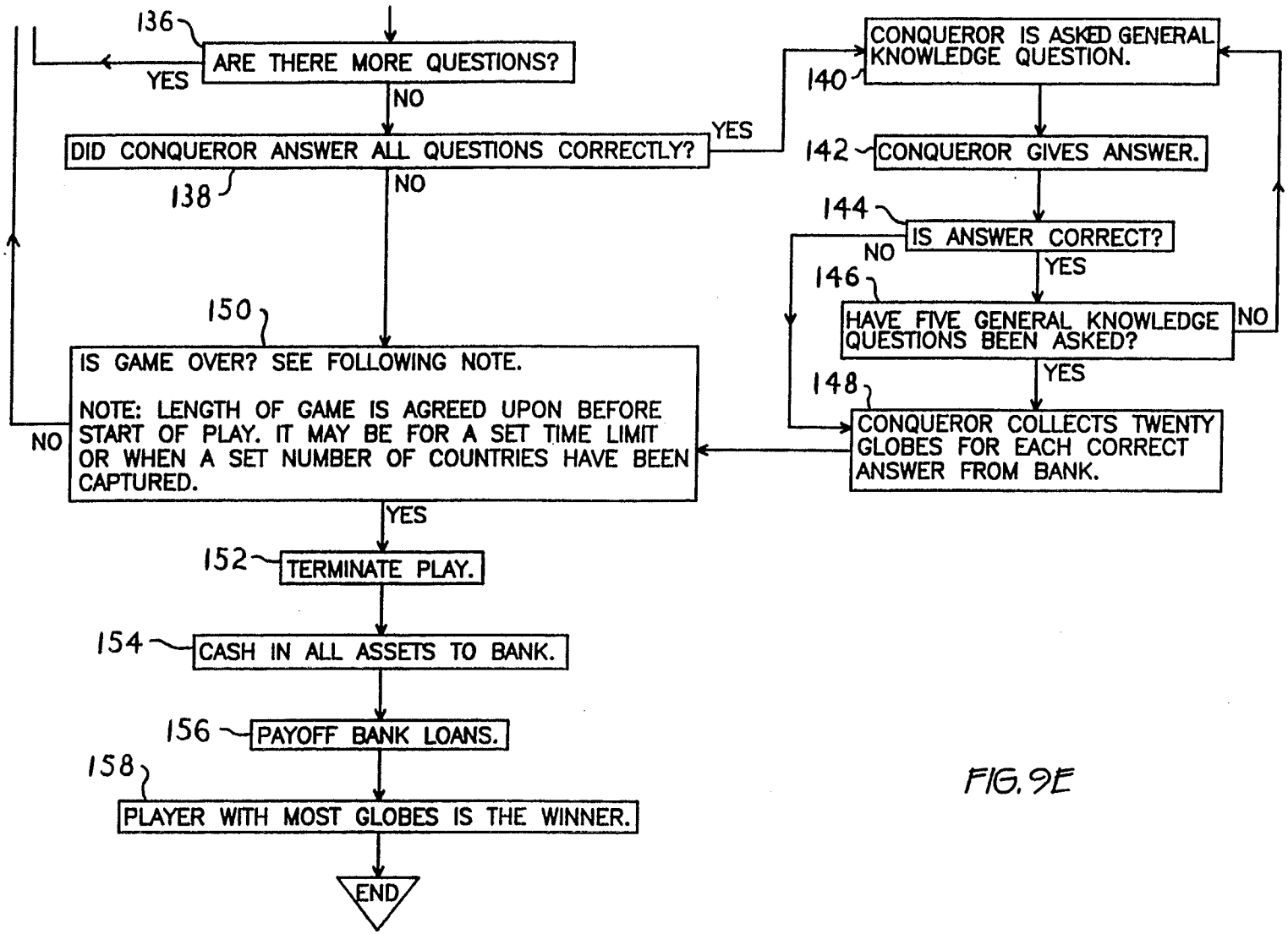

The above question and response phase, with challenges thereto, continues so long as there are questions relating to the conquered nation, as indicated in the thirty fifth step 136, FIG. 9E. If the conqueror has correctly answered all of the nation questions (i.e., he/she has attempted to answer all of the questions and no correct challenges have bee made), as indicated by the thirty sixth step 138 of FIG. 9E, then the game may progress to a series of general knowledge bonus questions, as in the thirty seventh step 140, FIG. 9E. An example of the general knowledge questions of the present game embodiments is provided below:

GENERAL KNOWLEDGE QUESTIONS

Q. What color is a Guernsey cow?
A. Brown and white.
Q. What color is a Holstein cow?
A. Black and white.
Q. What causes rainbows?
A. Light from the sun refracts through rain drops and is dispersed into the colors of the spectrum.
Q. How does radar work?
A. Electromagnetic pulses are transmitted, which reflect off of objects to be received at the radar unit. The distance of the object is determined by the time for the pulse to return.
Q. All large commercial aircraft have transponders. What are they used for?
A. They return an amplified signal to a radar receiver, with additional coded information.
Q. Which has the coldest mean temperature, the arctic or Antarctica?
A. Antarctica.

As with the questions relating to the nations of the present games, examples of which were provided above, the general knowledge questions may be expanded upon over the above examples. Other questions relating to the physical world, technical matters, personalities, etc. may be provided as desired.

No challenge system is provided for responses to the general knowledge questions. Instead, the conquering player responds to the questions asked by the banker, as noted in the thirty eighth step 142 of FIG. 9E, and the banker verifies the correct answer; thirty ninth step 144, FIG. 9E. Correct answers are rewarded by the bank paying the respondent/conquering player, twenty globes for each correct answer, up to a maximum of five questions and answers, as indicated by the fortieth and forty first steps 146 and 148, FIG. 9E. The bank provides the payout for this phase of the game, since no challengers are permitted.

The above steps are repeated during the course of play, with players attempting to form squares to conquer a nation, the playing surface grid being rotated and playing pieces being removed therefrom according to the rules, national questions being asked, responded to and challenged, and general knowledge bonus questions being asked and responded to. The end of the game is determined as mutually agreed upon by the players, either may setting a time limit or by playing until a predetermined number of the nations included in the game, have been conquered, as indicated by the forty second step 150 of FIG. 9E. When the time limit is reached or the predetermined number of nations have been conquered, play is terminated (forty third step 152, FIG. 9E) and all playing pieces in the possession of the players are returned to the bank, which pays the players one half the purchase price for each piece.

Loans made by the bank to the players for the purchase of player position markers or pieces are also paid back to the bank at this point, with the above steps respectively indicated as the forty fourth step 154 and forty fifth step 156, FIG. 9E. The remaining simulated currency assets of the players (in globes) are counted, with the player having the greatest simulated wealth in globes being the winner (forty sixth step 158, FIG. 9E).

Figure 3:
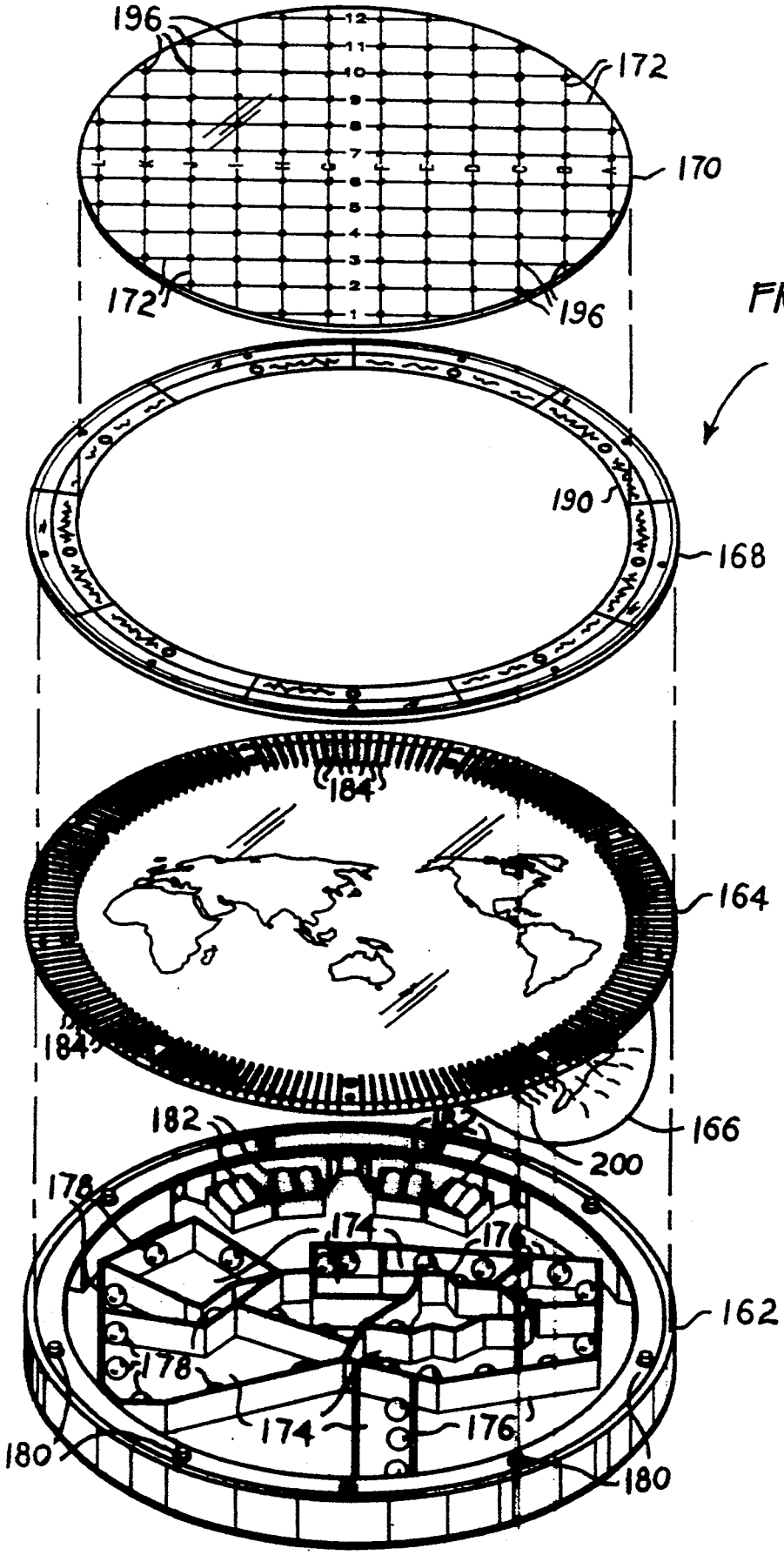
FIG. 3 is an exploded perspective view of the game board of the second embodiment of the present game, showing its features.

The above described game method and apparatus are manually actuated, with no electrical or other powered means providing for any part of the function or operation of the game. However, a second embodiment in which electrical illumination and magnetic actuation is provided for a portion thereof, is disclosed in FIGS. 3 and 4. FIG. 3 discloses an exploded view of an electrically illuminated and magnetically actuated game board 160, including a base portion 162, an overlying translucent cover 164 removably affixed thereto, a translucent map 166 underling the cover 164, a peripheral rim 168 removably secured to the upper periphery of the translucent cover 164, and a transparent rotatable playing surface or sheet 170 having a rectilinear grid 172 thereon and removably disposed atop the translucent cover 164 and laterally retained thereon by the peripheral rim 168.

Figure 8:
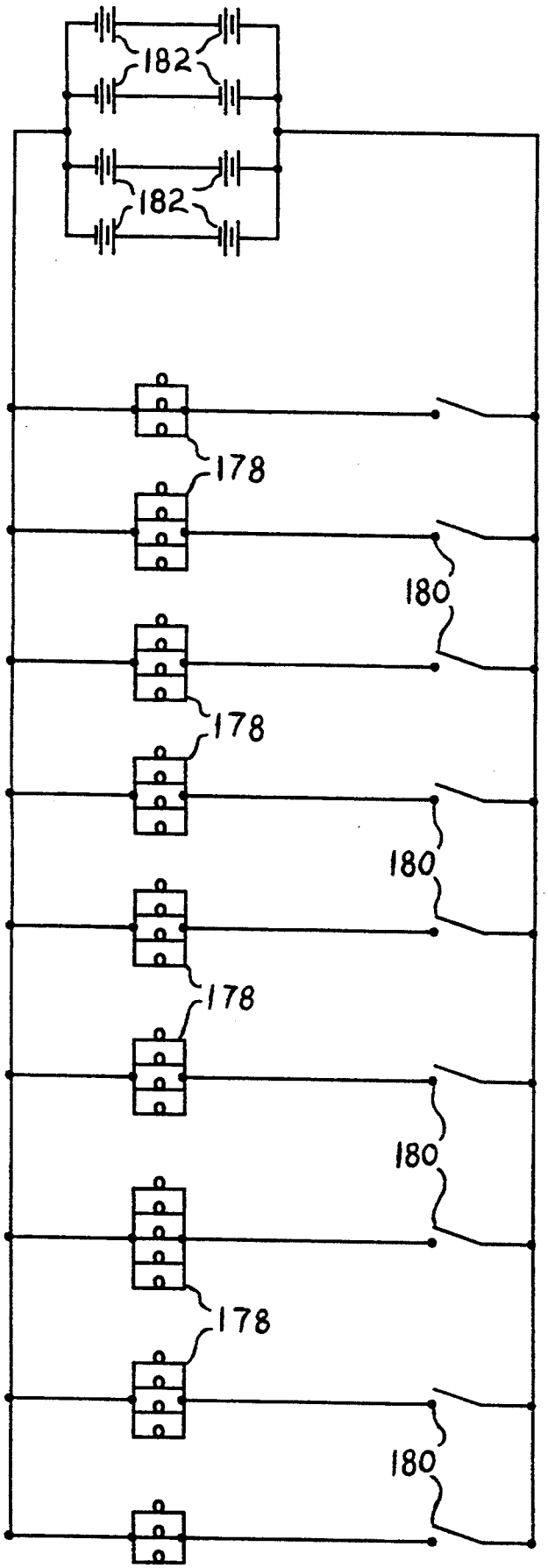
FIG. 8 is a schematic of the electrical system provided in the game board of the second embodiment of the present game.

The base portion 162 includes a hollow area therein, which is divided into a plurality of separate compartments 174 by a series of opaque partitions 176. The compartments 174 correspond to different regions of the overlying map 166, and contain lighting means 178, e.g., incandescent bulbs which may be affixed to the sides of the partitions 176. The lights 178 in each compartment 174 are separately actuated by a plurality of momentary contact switches 180; and electrical schematic is provided in FIG. 8

The above electrical illumination system is powered by one or more electrical batteries 182, which may be stored in the hollow area of the base portion 162 outside of any of the illuminated compartments 174; other electrical power sources may be used if desired. The batteries 182 provide electrical power to each of the switches 180, which in turn are each wired in series with their specific lighting means 178 to provide illumination for their specific region. (Wiring is shown schematically in FIG. 8.) Thus, when any one of the switches 180 is momentarily depressed, the specific series circuit controlled by that switch 180 will be closed and the corresponding lights 178 for that region will be illuminated, to shine through the overlying portion of the map 166 and rotatable surface 170 with its grid 172.

The translucent cover 164 includes a plurality of radially disposed peripheral slots 184 therein, more clearly shown in FIG. 4. Preferably, 162 of these slots 184 are provided, with one for each nation included in the present game, as in the embodiment of FIG. 1. The slots 184 are covered by the peripheral rim 168 and includes a retaining flange 186 (FIG. 4) which serves to capture a plurality of national flags 188 therein. The flags 188 are concealed beneath an overlying circumferential band 190, which band 190 includes the names of the various regions (preferably nine, including the various continents and major ocean areas) thereon. Each of the regional names on the regional band 190 is positioned adjacent the appropriate switch 180 which activates the lighting means 178 for that particular region. The flags 188 each include a depending flange 192, which is captured within a slot 184 to preclude any movement other than radial for the flags 188.

Each of the flags 188 is magnetically attractive (i.e., at least partially formed of ferrous metal), and is actuated by a permanent magnet 194, as shown in FIG. 4. Before the game is begun, the flags 188 are each retracted into their respective slots 184 to lie under the regional band 190, by using the magnetic means 194. As the game is played, the flags are withdrawn from beneath the regional band 190 to expose the flag 188 of the selected nation, in the manner of the withdrawal of the numbered nation tabs 22 of the game of the first embodiment.

The above arrangement has the advantage of retaining the movable flags 188 within the game apparatus 160 at all times, in order to preclude their loss. The game of the second embodiment may provide further security for the player position markers during play, by including a plurality of marker peg holes 196 (FIG. 3) at each of the grid 172 intersections on the rotatable playing surface 170. Thus, the use of player position markers having pegs 56 depending from the bases thereof and engaging the holes 196 within the playing surface 170, provides greater security for the positions of those markers when the playing surface 170 is rotated during the course of play.

The game of the second embodiment of FIGS. 3 and 4 is played essentially as the game of the first embodiment described above, with the exception of the magnetic operation of the peripheral national flags 188 and the electrically lighted regions of the board. When a square is formed on the rotatable playing surface 170 using the player position markers, in the manner described in the seventh step 80 of FIG. 9A, the player must only name a nation within that square, but must also identify the correct region which includes that nation, by operating a switch 180.

When one of the switches 180 is closed, as indicated in the first alternate step 198 of FIG. 9B for the game of the second embodiment, the related region of the board will be illuminated by the appropriate lights 178 shining through the overlying map 166, which map 166 includes regional numbered indices 200 of the nations of each particular region. Thus, the specific nation names by the conquering player who has formed the square with his/her markers, will be one of the nations displayed in the illuminated region of the map 166 and the accompanying illuminated numbered index of nations within that region, if the player has chosen the correct switch 180. This is indicated by the second alternate step 202 of FIG. 9B.

Assuming that the conquering player has selected the proper switch 180 to illuminate the proper region in which his/her named nation is located, the player or banker than uses the magnetic means 194 to withdraw the correct national flag 188 from beneath the regional band 190, as indicated in the third alternate step 204 of FIG. 9B. The name of the corresponding nation and its capitol may also be displayed when the flag 188 is magnetically withdrawn. The flag 188 remains in an outwardly disposed position during the balance of play of the game of the second embodiment, in order to indicate that its nation has been conquered and is no longer available for other players to conquer. The remainder of the board game of global conquest of the second embodiment of FIGS. 3 and 4, and including first through third alternate steps 198, 202, and 204 of FIG. 9B, is played in accordance with the rules and steps discussed above for the play of the game of the first embodiment shown generally in FIG. 1.

The above board games of global conquest will be seen to provide an entertaining and challenging means of acquiring, displaying, and testing geopolitical and other knowledge relating to the various nations of the globe. The general knowledge phase used in both games extends beyond the geopolitical knowledge required by the question and challenge phase, and provides a further test of the knowledge of the players. The escalating challenges, provision for removal and reuse of player position markers during the course of play and use of at least one marker per player which is not physically placed on the board during play, and rotatable playing surfaces, provide embodiments of a board game of global conflict which serve to challenge and hold the interest of players and to educate those players in subjects relating to the geopolitical system of our world.

it is to be understood that the present invention is not limited to the sole embodiments described above, but encompasses any and all embodiments within the scope of the following claims.

I claim:

1. A board game of global conquest comprising:

a generally circular game board having a fixed base portion with a plurality of radially disposed peripheral slots therearound, with a global map displaying the nations of the world thereon;

a circular and transparent sheet with a rectilinear grid rotatably disposed thereover, with said grid providing a plurality of playing positions and said sheet providing for the viewing of said global map therethrough;

a plurality of radially movable tabs disposed within said radially disposed peripheral slots of said fixed base portion, and;

a plurality of playing pieces having different configurations, with said different configurations limiting said playing pieces to specific areas of said game board, whereby;

players alternatingly and selectively place said playing pieces upon said grid and attempt to surround at least a portion of one of said nations to conquer said one of said nations, selectively move one of said radially movable tabs corresponding to said one of said nations, said selectively rotate said rotatably disposed transparent sheet to displace other said playing pieces from positions on said grid over said global map.

2. The board game of claim 1 including:

a plurality of national question sheets, with each sheet containing a plurality of questions relating to a specific nation.

3. The board game of claim 1 including:

a plurality of units of simulated currency of different denominations.

4. The board game of claim 1 wherein:

said radially movable tabs are completely removable from said radially disposed peripheral slots of said circular base portion, with each of said tabs having a first surface containing a different numeral thereon and an opposite second surface containing the name of a nation corresponding to said numeral on said first surface.

5. The board game of claim 1 wherein:

said base portion includes a translucent cover affixed thereover and lighting means disposed within said base portion and underlying said translucent cover, with said global map being affixed to said translucent cover and said translucent cover including a plurality of radially disposed peripheral slots therearound, and;

a transparent peripheral rim is overlyingly affixed to said translucent cover and said peripheral slots, with said circular and transparent rectilinear grid being rotatably disposed within said transparent peripheral rim and overlying said base portion and said translucent cover.

6. The board game of claim 5 including:

a plurality of momentary contact switches providing for the selective actuation of said lighting means, with said base portion being divided into different regions and each of said switches providing for the selective illumination of a different one of said regions.

7. The board game of claim 5 wherein:

said radially movable tabs are captured within said peripheral slots by said transparent peripheral rim overlying said translucent cover.

8. The board game of claim 5 wherein:

said radially movable tabs each include representations of flags of different nations thereon.

9. The board game of claim 5 wherein:

said radially movable tabs are each formed at least partially of ferrous metal, and;

said board game includes a magnet providing for the magnetic movement of said radially movable tabs.

10. A method of playing a board game of global conquest for a plurality of players, comprising the following steps:

providing a generally circular game board having a fixed base portion with a plurality of radially disposed peripheral slots therearound, with a global map displaying the nations of the world thereon and identified by a discrete number, with said game board having a circular and transparent sheet with a rectilinear grid rotatably disposed thereover, with said grid providing a plurality of playing positions and said sheet providing for the viewing of said global map therethrough;

further providing a plurality of radially movable tabs disposed within said radially disposed peripheral slots of said fixed base portion, with each of said tabs having a face up first said containing a number corresponding to said discrete number of one of said nations and an opposite second side containing at least the name of that nation;

further providing an equal amount of simulated currency to each player;

determining the order of play by the players;

further providing a set of playing pieces for each of the players with each said set containing playing pieces of like color, and with each of said playing pieces of said set having a different configuration and permitted pattern of movement, and with said different configurations limiting said playing pieces to specific areas of said game board during play;

requiring each of the players to purchase one said set of playing pieces for use during play of the game, by using at least some of said simulated currency;

each player alternatingly placing one of that player's playing pieces on said grid in a position as limited by said different configurations of said pieces and further attempting to form a square pattern of playing pieces of that player's set, the pattern at least partially encompassing at least one of said nations depicted on said global map and simulating the conquering thereof;

identifying at least one nation at least partially encompassed by the square pattern;

verifying the identity of the at least one nation by withdrawing one of said radially movable tabs having a number corresponding to the identified nation from one of said radially disposed peripheral slots of said fixed base portion, and noting the name of the nation on the second side of said tab;

receiving an additional amount of said simulated currency for a successful identification, and removing any said playing pieces used to from the square pattern and returning said playing pieces to the player forming the square, and;

continuing in the above manner to the end of the game, with the player having the greatest amount of simulated currency at the end of the game being the winner of the game.

11. The method of playing a board game of claim 10, including the steps of:

selectively rotating said circular and transparent sheet and said rectilinear grid rotatably disposed over said game board, thereby selectively displacing said playing pieces placed upon said grid to overly different areas of said global map, and;

removing from said grid any said playing pieces which are incompatible with said different areas thereunder.

12. The method of playing a board game of claim 11, including the steps of:

allowing players to purchase said playing pieces previously removed from the board, and;

alternatingly playing the previously removed said playing pieces on the board to continue play of the game.

13. The method of playing a board game of claim 10, including the steps of:

providing at least one stealth playing piece for each said set of playing pieces and providing for the virtual placement of said each said stealth playing piece upon said grid and precluding physical placement on said grid of said each said stealth playing piece;

providing for the recordation of the virtual position of said each said stealth playing piece on said grid by the players controlling said each said stealth playing piece, and;

precluding disclosure of the virtual positions of said each said stealth playing piece to other players.

14. The method of playing a board game of claim 10, including the steps of:

providing a plurality of supplemental questions for each nation;

providing an answer by a first player for at least one of said supplemental questions, and;

providing additional simulated currency for a correct answer by the first player.

15. The method of playing a board game of claim 14, including the steps of:

providing an escalating challenge by allowing a second player to challenge an answer by a first player to said at least one of said supplemental questions;

requiring the second player to provide an alternative answer to said at least one of said supplemental questions;

continuing in the above manner until no further challenges are issued by any player, and;

providing additional simulated currency for an answer by the last challenging player.

16. The method of playing a board game of claim 10, including the steps of:

providing a plurality of bonus questions;

providing an answer by a player for at least one of said supplemental questions, and;

providing additional simulated currency for a correct answer by the player.

17. The method of playing a board game of claim 10, including the steps of:

providing a translucent cover affixed over said base portion;

further providing lighting means disposed within said base portion and underlying said translucent cover;

affixing said global map to said translucent cover and providing a plurality of radially disposed peripheral slots around said translucent cover;

overlying affixing a transparent peripheral rim to said translucent cover and said peripheral slots;

rotatably disposing said circular and transparent sheet with said rectilinear grid within said transparent peripheral rim and overlying said base portion and said translucent cover;

further providing a plurality of momentary contact switches providing for the selective actuation of said lighting means, and dividing said base portion into different regions with each of said switches providing for the selective illumination of a different one of said regions, and;

identifying one of said regions at least partially encompassed by the square pattern, and actuating one of said switches corresponding to the identified one of said regions.

18. The method of playing a board game of claim 17, including the steps of:

providing said radially movable tabs of ferrous material and with a flag pattern corresponding to said one of said nations, and;

capturing said radially movable tabs within said peripheral slots between said transparent peripheral rim and said translucent cover and providing a magnet for radially moving said tabs.

19. The method of playing a board game of claim 10, including the steps of:

returning said playing pieces for an amount of simulated currency at the end of a predetermined elapsed time of play, and;

determining the winner of the game as the player having the greatest amount of simulated currency after returning said playing pieces at the end of a predetermined elapsed time of play.

20. The method of playing a board game of claim 10, including the steps of:

returning said playing pieces for an mount of simulated currency at the end of the simulated conquering of a predetermined number of said nations of the game, and;

determining the winner of the game as the player having the greatest amount of simulated currency after returning said playing pieces after the simulated conquering of a predetermined number of said nations of the game.

* * * * *